US011679409B2

(12) United States Patent
Kanoatov et al.

(10) Patent No.: US 11,679,409 B2
(45) Date of Patent: Jun. 20, 2023

(54) REACTORS FOR COATING DEVICES AND RELATED SYSTEMS AND METHODS

(71) Applicant: Covalon Technologies Inc., Mississauga (CA)

(72) Inventors: Mirzo Kanoatov, Toronto (CA); Genevieve Conant, Mississauga (CA); Darryl Knight, Mississauga (CA); Daryl Sivakumaran, Ancaster (CA)

( * ) Notice: Subject to any disclaimer, the term of this patent is extended or adjusted under 35 U.S.C. 154(b) by 24 days.

(21) Appl. No.: 17/123,390

(22) Filed: Dec. 16, 2020

(65) Prior Publication Data

US 2021/0178423 A1 Jun. 17, 2021

Related U.S. Application Data

(60) Provisional application No. 62/948,923, filed on Dec. 17, 2019.

(51) Int. Cl.

| | |
|---|---|
| ***B05D 1/18*** | (2006.01) |
| ***B05C 13/02*** | (2006.01) |
| ***B05C 3/08*** | (2006.01) |

(52) U.S. Cl.

CPC ..... *B05D 1/18* (2013.01); *B05C 3/08* (2013.01); *B05C 13/02* (2013.01)

(58) Field of Classification Search

CPC ..... B05C 3/109; B05C 3/10; B05C 13/025; B65G 49/0459

USPC ..... 427/2.1–2.31; 118/407–408, 416, 423, 118/428–429

See application file for complete search history.

(56) References Cited

U.S. PATENT DOCUMENTS

| | | | | | |
|---|---|---|---|---|---|
| 2,808,344 | A | * | 10/1957 | Kaulen | G03F 7/18 430/935 |
| 3,529,529 | A | * | 9/1970 | Schumacher | G03D 3/065 396/564 |
| 3,733,993 | A | * | 5/1973 | Lasky | G03D 3/065 204/232 |
| 4,778,532 | A | * | 10/1988 | McConnell | H01L 21/67028 134/28 |
| 4,856,544 | A | * | 8/1989 | McConnell | B05C 3/109 134/95.1 |
| 4,899,767 | A | * | 2/1990 | McConnell | B08B 7/0092 134/186 |
| 5,693,372 | A | * | 12/1997 | Mistrater | B05C 3/109 427/430.1 |
| 5,720,815 | A | * | 2/1998 | Swain | B05C 3/109 118/500 |

(Continued)

FOREIGN PATENT DOCUMENTS

| | | |
|---|---|---|
| WO | 0209786 A2 | 2/2002 |
| WO | 02060507 A1 | 8/2002 |

OTHER PUBLICATIONS

International Search Report for PCT/CA2020/051728 dated Mar. 8, 2021, 3 pages.

*Primary Examiner* — Cachet I Proctor

(74) *Attorney, Agent, or Firm* — Myers Bigel, P.A.

(57) ABSTRACT

A reactor for coating a device is provided. The reactor comprises a hollow body and a port. The hollow body is for supporting the device. The port is in fluid communication with the hollow body for exchanging a coating fluid. In use, the device is moveable within the hollow body from a stacked orientation to an unstacked orientation. Processes for coating devices and systems thereof are also provided.

36 Claims, 16 Drawing Sheets

(56) References Cited

U.S. PATENT DOCUMENTS

| | | | | |
|---|---|---|---|---|
| 6,001,894 | A * | 12/1999 | Ottersbach | C08J 7/18 427/520 |
| 6,207,218 | B1 * | 3/2001 | Layrolle | A61F 2/30767 427/2.27 |
| 6,207,337 | B1 * | 3/2001 | Swain | G03G 5/04 427/430.1 |
| 6,808,738 | B2 | 10/2004 | Ditizio et al. | |
| 6,994,883 | B2 * | 2/2006 | Layrolle | A61F 2/30767 427/403 |
| 8,361,501 | B2 | 1/2013 | Ditizio et al. | |
| 8,746,168 | B2 * | 6/2014 | Abbasian | C09D 4/00 118/423 |
| 8,840,927 | B2 | 9/2014 | Ditizio et al. | |
| 8,877,256 | B2 | 11/2014 | Dudnik et al. | |
| 8,920,886 | B2 | 12/2014 | Abbasian et al. | |
| 8,967,077 | B2 | 3/2015 | Abbasian et al. | |
| 2004/0020518 | A1 * | 2/2004 | DeYoung | H01L 21/02063 257/E21.228 |
| 2004/0033306 | A1 * | 2/2004 | Bouchier | B05C 3/04 118/400 |
| 2004/0161547 | A1 * | 8/2004 | Carlson | B05C 3/109 118/715 |
| 2005/0098098 | A1 * | 5/2005 | Biver | B29D 11/00865 118/500 |
| 2006/0210699 | A1 * | 9/2006 | Collins | B05C 3/09 118/400 |
| 2018/0296737 | A1 | 10/2018 | Sivakumaran et al. | |

* cited by examiner

REACTORS FOR COATING DEVICES AND RELATED SYSTEMS AND METHODS

RELATED APPLICATIONS

This application claims priority from U.S. Provisional Patent Application No. 62/948,923, filed Dec. 17, 2019, the disclosure of which is incorporated by reference in its entirety.

FIELD

The present disclosure relates to reactors. In particular, the present disclosure relates to reactors for coating devices, as well as related processes and systems.

BACKGROUND

U.S. Pat. No. 8,840,927 is directed to a method for the modification of the surfaces of polymeric materials with polymer coatings that may be subsequently treated to be lubricious and anti-microbial. The method comprises incubating a photo-initiator-coated polymeric material with an aqueous monomer that is capable of free radical polymerization and exposing the incubating polymeric material to UV light creating a modified surface on said polymeric material. The method may additionally comprise adding a silver component to the modified surface. The silver component may be provided as a silver salt coating or a silver salt contained within a hydrogel bonded to the acrylate modified polymeric material surface.

U.S. Pat. No. 8,967,077 is directed to system and method for photo-grafting a coating polymer onto the surface of a medical device are provided. The system comprises a plurality of stations including a novel grafting station. The system and method of the invention are both time- and resource-efficient. The system includes several stations, each station including a dipping tank. The system allows for the automated, semi-automated, or manual dipping of medical devices into the dipping tanks in a specified order, as desired, wherein at least one of the stations is a grafting station for photo-grafting the coating polymer onto the surface of the medical device. The system is modular, which allows for modification of the process as required, depending on the needs of the user. The system may comprise stations for incorporating an antimicrobial agent into the coating, and/or for rendering the coating lubricious.

SUMMARY

In accordance with an aspect, there is provided a reactor for coating a device, the reactor comprising:

a hollow body for supporting the device; and a port in fluid communication with the hollow body for exchanging a coating fluid.

In an aspect, the device is movable within the hollow body from a stacked orientation to an unstacked orientation.

In an aspect, the hollow body is sufficiently longer than the device to permit the device to move substantially freely within the hollow body in the unstacked orientation.

In an aspect, the hollow body is at least 50%, 60%, 70%, 80%, 90%, 100%, 110%, 120%, 130%, 140%, 150%, 160%, 170%, 180%, 190%, 200%, 250%, 300%, 350%, 400%, 450%, 500%, 550%, or 600% longer than the device.

In an aspect, the hollow body has a cross-sectional area that is sufficiently similar to that of the stacked device to restrict the device from moving substantially freely within the hollow body in the stacked orientation.

In an aspect, the hollow body has a diameter that is smaller than the length of the device to ensure that the device remains in a desired orientation in the unstacked orientation.

In an aspect, the reactor further comprises an unstacker for releasing the device from the stacked orientation.

In an aspect, the unstacker is movable along the length of the hollow body.

In an aspect, the unstacker comprises an unstacker flange.

In an aspect, movement of the unstacker flange disrupts the stacked orientation.

In an aspect, movement of the unstacker flange provides a gap, optionally a gap between a plurality of stacked devices, that disrupts the stacked orientation.

In an aspect, the unstacker flange is porous and/or flexible.

In an aspect, the unstacker further comprises an unstacker rod coupled to the unstacker flange for movement of the unstacker flange through the hollow body.

In an aspect, the unstacker rod extends axially through the hollow body.

In an aspect, the reactor further comprises a restrictor for encouraging the stacked orientation.

In an aspect, the restrictor is movable along the length of the hollow body.

In an aspect, the restrictor comprises a restrictor flange.

In an aspect, the movement of the restrictor flange allows for release of the device from the stacked orientation.

In an aspect, the restrictor further comprises a restrictor rod coupled to the restrictor flange for movement of the restrictor flange through the hollow body.

In an aspect, the restrictor rod extends axially through the hollow body.

In an aspect, the unstacker rod extends axially through the restrictor rod.

In an aspect, the unstacker rod and the restrictor rod move independently from each other or collectively.

In an aspect, the port is at one end of the hollow body.

In an aspect, the port is at a bottom end of the hollow body.

In an aspect, the port is at a top end of the hollow body

In an aspect, the port is at a top and a bottom of the hollow body.

In an aspect, the reactor further comprising a stopper at a top end of the hollow body.

In an aspect, the port extends through the stopper for fluid flow.

In an aspect, the stopper defines a void having a convex shape to guide fluid to the port.

In an aspect, the convex shape is frusto-conical, conical, or parabolic.

In an aspect, the fluid is a gas.

In an aspect, the restrictor rod and/or the unstacker rod extend through the stopper.

In an aspect, when the unstacker rod and the restrictor rod move through the stopper, a gasket coupled to the unstacker rod slides into a gasket coupled to the restrictor rod that collectively abut against a surface of the stopper to limit fluid flow through the stopper in the unstacked orientation.

In an aspect, the reactor further comprises a bottom stopper.

In an aspect, the port extends through the bottom stopper for exchanging the coating fluid.

In an aspect, the reactor further comprises an aerator.

In an aspect, the hollow body is cylindrical.

In an aspect, the hollow body is partially or completely transparent.

In an aspect, the hollow body is partially or completely UV transmissible.

In an aspect, the hollow body comprises glass.

In an aspect, the glass is borosilicate or quartz.

In an aspect, the device is a medical device.

In an aspect, the device is selected from the group consisting of cardiac valves, dressing, pins, clamps, clips, syringes, syringe accessories, catheters, drains, stents, implants, tubings, ocular lenses, and their delivery devices.

In an aspect, the device is cannular.

In an aspect, the device is a catheter.

In an aspect, the device is a plurality of devices, optionally wherein each of the plurality of devices is substantially identical.

In an aspect, the plurality of devices remain in contact during the exchange of the coating fluid.

In an aspect, the plurality of devices, when in the stacked orientation, are in contact with each other such that there are substantially no dead spaces.

In an aspect, the fluid exchange reduces air bubbles in and/or around the plurality of devices, optionally in respective lumens of the plurality of devices.

In an aspect, the reactor is movable between a substantially vertical position and a substantially horizontal position.

In an aspect, movement from the substantially vertical position to the substantially horizontal position encourages the unstacked orientation.

In an aspect, the unstacked orientation and/or the substantially horizontal position encourages substantially uniform covering of the device with the coating fluid.

In an aspect, the unstacked orientation and/or the substantially horizontal position encourages substantially even dispersion of the device throughout the hollow body.

In an aspect, the plurality of devices are not exposed to air during or after the exchange of coating fluid.

In an aspect, the coating fluid comprises a fluid selected from the group consisting of a photoinitiator, a monomer, water, an alcohol and combinations thereof.

In an aspect, the photoinitiator is selected from the group consisting of peresters, α-hydroxyketones, benzil ketals, benzoins, derivatives thereof, and combinations thereof.

In an aspect, the photoinitiator is selected from the group consisting of 2,2-dimethoxy-2-phenyl-acetophenone (DPA), p-benzoyl tert-butylperbenzoate (BPB), tert-butylperoxybenzoate (TBP), benzophenone (BP) and combinations thereof.

In an aspect, the photoinitiator comprises benzophenone and tert-butylperoxybenzoate.

In an aspect, the monomer solution is selected from the group consisting of acrylic acid, methacrylic acid, 2-carboxyethyl acrylate, 4-vinylbenzoic acid, itaconic acid, methyl acrylate, and combinations thereof.

In an aspect, the monomer solution comprises acrylic acid and methyl acrylate.

In an aspect, the monomer solution, water, and/or alcohol are purged with an oxygen-scavenging gas.

In an aspect, the oxygen-scavenging gas is selected from the group consisting of nitrogen, argon, helium, and combinations thereof.

In an aspect, the oxygen-scavenging gas is nitrogen.

In an aspect, the water is deionized water.

In an aspect, the alcohol is a low surface tension alcohol solution.

In an aspect, the alcohol is selected from the group consisting of methanol, ethanol, isopropyl alcohol, and combinations thereof.

In an aspect, the reactor is for coating the device in a one-pot process of coating fluid exchange.

In an aspect, the exchange of the coating fluid is fully automated, semi-automated, or manual.

In accordance with an aspect, there is provided a system comprising a reactor bracket for supporting the reactor as described herein and a swiveling mechanism for changing the orientation of the reactor bracket from a first orientation to a second orientation.

In an aspect, the first orientation is a substantially vertical orientation.

In an aspect, the first orientation is a vertical orientation.

In an aspect, the second orientation is a substantially horizontal orientation.

In an aspect, the second orientation is a horizontal orientation.

In an aspect, the system further comprises a lamp assembly attachable to the reactor bracket for initiating a polymerization reaction within the reactor.

In an aspect, the lamp assembly comprises a UV light source.

In an aspect, the UV light source has a wavelength of between about 100 nm and about 400 nm.

In an aspect, the UV light source has a wavelength of between about 300 nm and about 365 nm In an aspect, the system comprising one or more of the reactors as defined herein.

In accordance with an aspect, there is provided a one-pot process for coating a device, the process comprising: exchanging a coating fluid within a reactor; and coating the device with the coating fluid such that the coating fluid covers a surface of the device.

In an aspect, the device is continually submerged in the coating fluid such that the device is not exposed to air.

In an aspect, the exchanging coating fluid minimizes bubble formation inside and/or outside the device.

In an aspect, the process comprises submerging the device in alcohol to removing air bubbles and exchanging subsequent fluids while keeping the device submerged without substantially exposing the device to air.

In accordance with an aspect, there is provided a one-pot process for fluid-treating a device and reducing bubble formation, the process comprising submerging the device in alcohol and exchanging the alcohol with the fluid for treatment.

The novel features of the present invention will become apparent to those of skill in the art upon examination of the following detailed description of the invention. It should be understood, however, that the detailed description of the invention and the specific examples presented, while indicating certain aspects of the present invention, are provided for illustration purposes only because various changes and modifications within the spirit and scope of the invention will become apparent to those of skill in the art from the detailed description of the invention and claims that follow.

BRIEF DESCRIPTION OF THE DRAWINGS

The present invention will be further understood from the following description with reference to the Figures.

DETAILED DESCRIPTION

Figure 1:
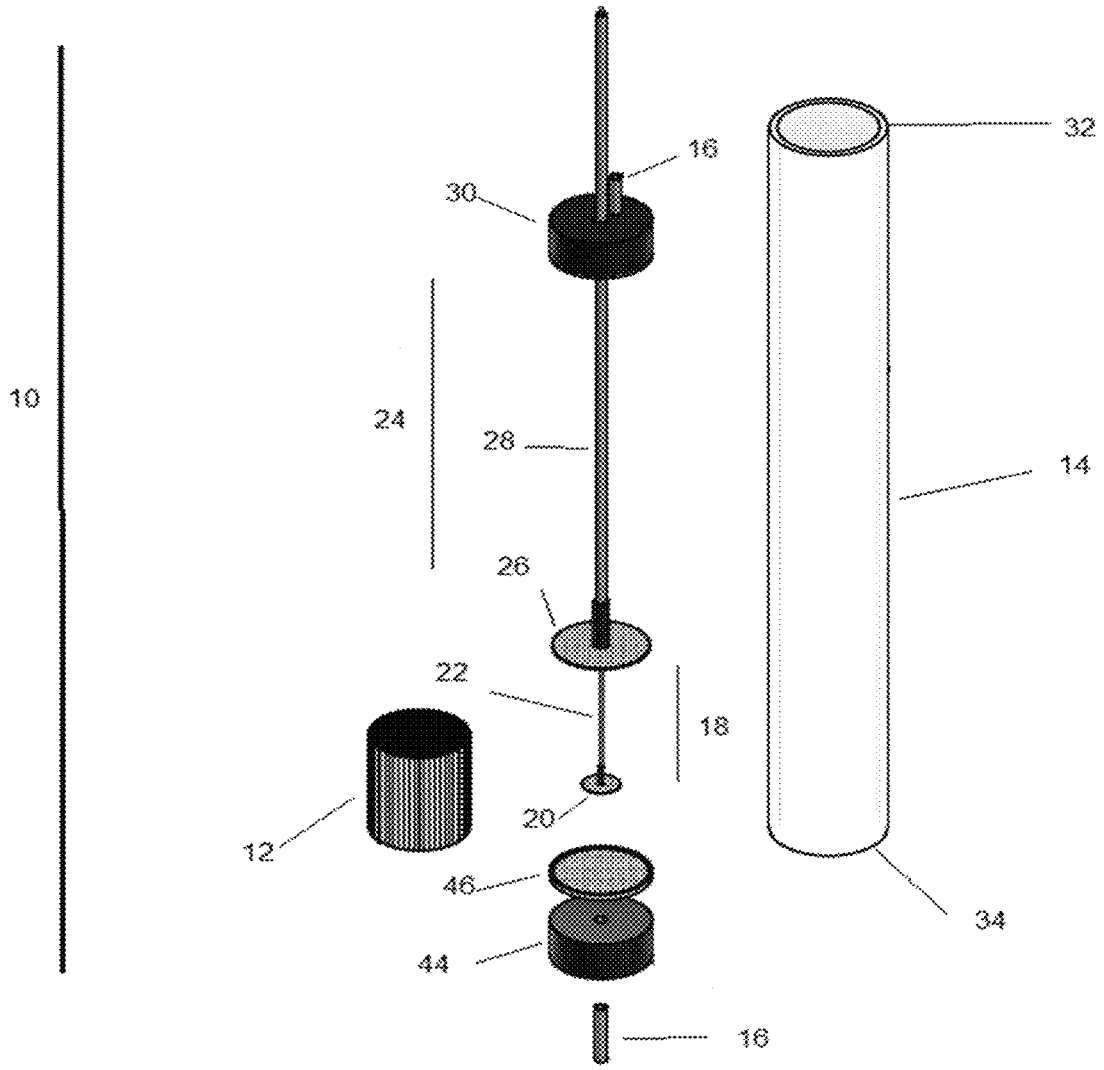
FIG. 1 shows an exploded view of components of a reactor in accordance with the present invention.

Described herein are devices, such as reactors, that are suitable for treating one or more devices with one or more fluids. Usually, such devices are dipped sequentially into various vats of fluid for polymerizing a coating onto the surfaces of the devices. Examples of such methods and coating compositions for use in such methods are described in, for example, U.S. Pat. Nos. 6,808,738, 8,361,501, 8,746,168, 8,840,927, 8,877,256, 8,920,886, and 8,967,077, and U.S. Patent Application Publication No. 2018/0296737, which are incorporated herein by reference in their entirety for describing various coating compositions, procedures, and methods.

In aspects, the reactor described herein is capable of sequentially treating a device with a variety of fluids that are gradually exchanged with one another while substantially avoiding introducing air bubbles into the process. When air bubbles are on the surface of a device while it is being coated with a fluid, these bubbles may interfere with full and homogeneous coating of the device. Further, the reactors described herein are designed to maintain the devices in a regularly oriented "stacked" configuration during the first step(s) in the coating process and to then disrupt the regular orientation or "unstack" the devices for a polymerization step in the process, so that the coating can be substantially uniformly polymerized on the surface.

In aspects, the devices are stacked against a bottom surface of the reactor and optionally held in place with a restrictor that assists in maintaining the orientation of the devices while fluid is being exchanged and otherwise moving about in the reactor. The fluid level is maintained above the level of the top of the devices so that they remain substantially submerged throughout the coating process. The gradual fluid exchange reduces opportunities for gas bubbles to form in and/or on the devices.

Typically, an alcohol-based photoinitiator solution is introduced first into the reactor so that the devices and the restrictor are fully submerged. An oxygen-scavenging gas is typically introduced through the bottom of the reactor to remove dissolved oxygen from the fluid and the surface of the devices. After the gas flow through the reactor ceases, the low surface tension of the alcohol-based photoinitiator solution promotes effective removal of gas bubbles from inside and around of the devices. This process removes air from the devices and does not tend to introduce any air bubbles that would interfere with the subsequent coating process. All fluids after this point, such as any wash solutions and monomers are exchanged with the fluid in the reactor in a gradual fashion so that the devices remain submerged throughout the process. This avoids introducing any air bubbles into the devices.

The reactors described herein are amenable to scaling and high throughput coating methods. Many devices can be coated in each reactor and many reactors can be run in parallel.

Definitions

Unless otherwise explained, all technical and scientific terms used herein have the same meaning as commonly understood by one of ordinary skill in the art to which this disclosure belongs. Although any methods and materials similar or equivalent to those described herein can be used in the practice for testing of the present invention, the typical materials and methods are described herein. In describing and claiming the present invention, the following terminology will be used.

Relative terms are meant to help in the understanding of the technology. For example, the term "top" is meant to be relative to the term "bottom," the term "above" is meant to be relative to the term "below," the term "upward" is meant to be relative to the term "downward," the term "back" is meant to be relative to the term "front," and the term "horizontal is meant to be relative to the term "vertical." Rotating a component may change the terminology, but not the meaning.

When introducing elements disclosed herein, the articles "a", "an", "the", and "said" are intended to mean that there may be one or more of the elements.

The term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. It will be understood that any embodiments described as "comprising" certain components may also "consist of" or "consist essentially of," these components, wherein "consisting of" has a closed-ended or restrictive meaning and "consisting essentially of" means including the components specified but excluding other components except for materials present as impurities, unavoidable materials present as a result of processes used to provide the components, and components added for a purpose other than achieving the technical effects described herein.

It will be understood that any component defined herein as being included may be explicitly excluded from the claimed invention by way of proviso or negative limitation, such as any specific coating fluids or process steps, whether implicitly or explicitly defined herein. For example, in aspects, the coating process does not include an activating coating step for application of a therapeutic agent.

In addition, all ranges given herein include the end of the ranges and also any intermediate range points, whether explicitly stated or not.

Terms of degree such as "substantially", "about" and "approximately" as used herein mean a reasonable amount of deviation of the modified term such that the end result is not significantly changed. These terms of degree should be construed as including a deviation of at least ±5% of the modified term if this deviation would not negate the meaning of the word it modifies.

The abbreviation, "e.g." is derived from the Latin exempli gratia, and is used herein to indicate a non-limiting example. Thus, the abbreviation "e.g." is synonymous with the term "for example." The word "or" is intended to include "and" unless the context clearly indicates otherwise.

The phrase "at least one of" is understood to be one or more. The phrase "at least one of . . . and . . . " is understood to mean at least one of the elements listed or a combination thereof, if not explicitly listed. For example, "at least one of A, B, and C" is understood to mean A alone or B alone or C alone or a combination of A and B or a combination of A and C or a combination of B and C or a combination of A, B, and C.

Reactor for Coating Devices

The reactor will now be described in reference to the Figures. In general, a reactor 10 for coating a device 12, which is typically a plurality of devices 12, is described herein. In typical aspects, the reactor 10 allows for the device 12 to be coated in a "one-pot" process. By "one-pot" process, it is meant that the exchange of all of the coating fluids can take place in the reactor 10 itself, without the need for additional reactors (e.g. further fluid containing equipment), and that the exchange of all of the coating fluids within the reactor 10 is continuous. In this way, the coating fluids may be infused into the reactor 10 and exchanged continually such that the devices 12, when within the reactor 10, remain submerged in coating fluid throughout the process. This reduces exposure of the device 12 contained therein to air and/or reduces air bubble development in a lumen and/or an outside surface of the devices 12 during the coating process. Typically, the device 12 that is coated using the process is cannular, such as a catheter.

Figure 2:
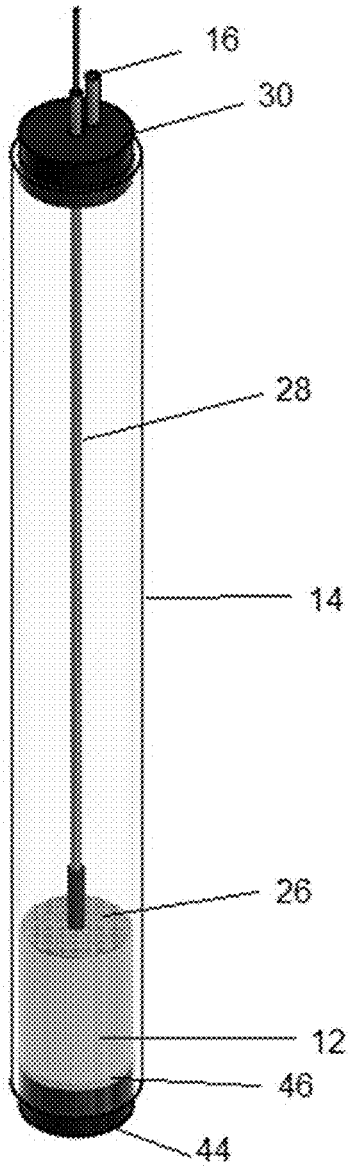
FIG. 2 shows a perspective view of the reactor of FIG. 1 assembled and in a vertical orientation with the devices stacked.

FIGS. 1-8 show the reactor 10 in assembled configurations, disassembled configurations, and varying orientations during the use thereof. FIG. 1 shows an exploded version of the reactor 10 and FIG. 2 shows the reactor 10 in its assembled configuration. As shown, the reactor 10 comprises a hollow body 14 for supporting the device 12 or plurality of devices 12, and a port 16, which is in fluid communication with the hollow body 14. In this way, the coating fluid may be exchanged within the hollow body 14 when the coating fluid is introduced into the hollow body 14 via the port 16. The hollow body 14 is typically transparent, such that it allows for the transmission of UV light therethrough to initiate and propagate the polymerization reaction during the coating process. The hollow body 14 is typically made of glass, such as for example, borosilicate or quartz, however, it will be understood that the hollow body 14 can be made from any material that can transmit UV light.

Figure 3:
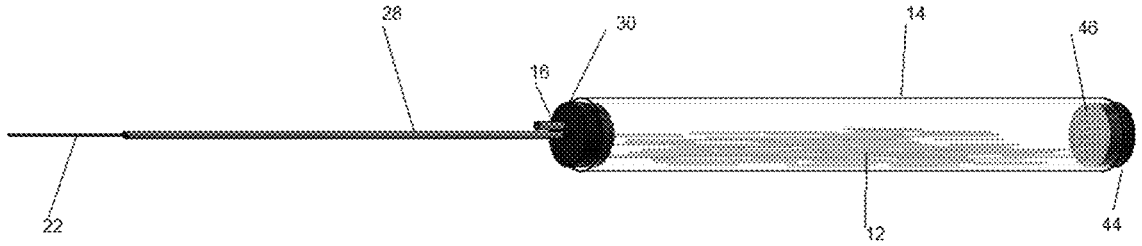
FIG. 3 shows a perspective view of the reactor of FIG. 2 assembled and in a horizontal orientation with the devices unstacked.

In typical aspects, the devices 12 are movable within the hollow body 14, such that they can assume different orientations as best seen in FIGS. 2 and 3, such as for example a stacked orientation (see FIG. 2) or an unstacked orientation (see FIG. 3) as described in greater detail below. By stacked orientation, it is meant that the devices 12 are in close contact with each other and there are substantially no dead spaces between the devices 12. For example, the devices 12 form an array where the devices 12 are in contact with each other. In typical aspects, the devices 12 remain in contact during the exchange of coating fluids when the devices 12 are in the stacked orientation. The stacked orientation facilitates the even, substantially bubble-free coating of the devices 12 with, for example, a polymerization solution and one or more wash solutions.

By unstacked orientation, it is meant that the devices 12 are not in close contact with each other and there are spaces between the devices 12. Typically, the devices are loosely contained and freely movable within the coating fluid contained within the hollow body 14. The unstacked orientation ensures that the devices 12 are fully coated with a monomer solution, for example, and assists in exposing all surfaces of the devices 12 to UV light during the polymerization reaction, resulting in a substantially complete and homogeneous coating over the surface of the device 12. Typically, the diameter of the reactor is smaller than the length of the device, to prevent the devices from falling sideways after unstacking.

A number of components are provided within the hollow body 14 to facilitate the stacking and unstacking of the devices 12 during the coating process. As shown in FIG. 1, the reactor 10 further comprises an unstacker 18 for releasing the devices 12 from the stacked orientation. In aspects, the unstacker 18 is movable along the length of the hollow body 14 in order to release of the devices 12 from the stacked orientation into the unstacked orientation and thereby permit, for example, free movement of the devices 12 within the hollow body 14.

In typical aspects, the unstacker 18 comprises an unstacker flange 20, which is disposed near the bottom of the hollow body under the devices 12 when the devices 12 are in the stacked position. When the unstacker 18 is drawn along the length of the hollow body 14, the unstacker flange 20 moves with the unstacker 18, thereby disrupting the stacked orientation by removing one or more devices 12 from the core of the stack. This creates a gap in the devices 12, which provides sufficient space for the devices 12 to be released from the stacked orientation and assume the unstacked orientation. In typical aspects, the unstacker flange 20 is sufficiently rigid to maintain its shape while removing one or more devices 12 from the core of the stack as described above. In additional or alternate aspects, the unstacker flange 20 is porous to thereby allow the flow of coating fluid within the hollow body 14 to pass therethrough. In this way, coating fluid contained within the hollow body 14 is not obstructed by the unstacker flange 20.

In typical aspects, the unstacker 18 further comprises an unstacker rod 22. In typical aspects, the unstacker flange 20 is coupled to the unstacker rod 22, such that the unstacker rod 22 and the unstacker flange 20 can move axially through the hollow body 14. In typical aspects, the unstacker rod 22 extends axially through the hollow body 14, and, typically, the unstacker rod 22 projects outside of the hollow body 14, to facilitate the axial movement thereof.

In typical aspects, the reactor 10 further comprises a restrictor 24. The restrictor 24 is biased against the devices 12 and encourages the devices 12 to remain in the stacked orientation. In this way, the restrictor 24 restricts movement of the stacked devices 12 when the coating fluid is introduced and/or exchanged within the hollow body 14 and during bubbling of the oxygen-scavenging gas within the hollow body 14. Further, the restrictor 24 may be tapped against the devices 12 by moving the restrictor up and down, away from and back into contact with the devices 12, to promote evacuation of any gas bubbles from the stacked devices 12.

Figure 9:
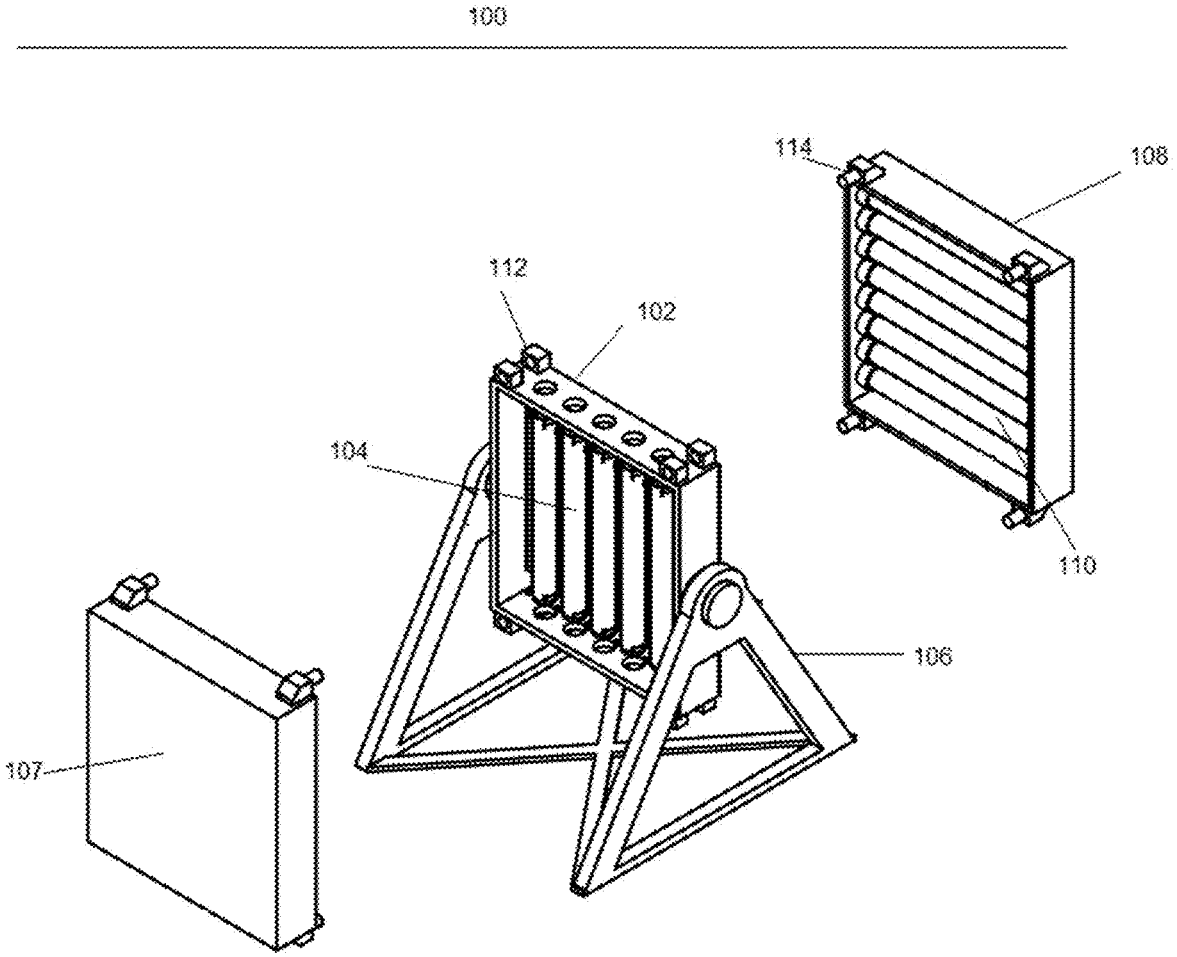
FIG. 9 shows an exploded view of components of a system in accordance with the present invention.

In typical aspects, the restrictor 24 is movable along the length of the hollow body 14. In aspects, when the restrictor 24 moves axially though the hollow body 14, it project outside of the hollow body 14 (see FIG. 9) such that the restrictor 24 is moved away from the devices 12. In this way, the devices 12 may assume the unstacked orientation described herein. In typical aspects, the restrictor 24 extends within the hollow body 14 (see FIG. 2) for maintaining the devices 12 in the stacked orientation. In typical aspects, the restrictor 24 comprises a porous restrictor flange 26 which is useful for abutting a surface of the devices 12 so as to limit movement of the devices 12 and maintain the devices 12 in the stacked orientation. Thus, it will be understood that movement of the restrictor flange 26 allows for release of the devices 12 from the stacked orientation into the unstacked orientation thereby facilitating coating of the devices 12. When porous, the restrictor flange 26 is permitted to allow the flow of coating fluid within the hollow body 14 to pass therethrough.

In typical aspects, the restrictor 24 further comprises a restrictor rod 28 which extends axially through the hollow body 14 and is movable therethrough. In aspects, the restrictor rod 28 is coupled to the restrictor flange 26 for movement through the hollow body 14. Movement of the restrictor flange 26 and/or the restrictor rod 28 through the hollow body 14 facilitates the movement of the devices 12 from the unstacked orientation to the stacked orientation. Further, the restrictor flange 26 may be used to partially re-stack the devices 12 as desired, for example, during a wash step.

In typical aspects, the restrictor rod 28 is hollow and capable of receiving the unstacker rod 22 axially therethrough. In aspects, the restrictor rod 28 and unstacker rod 22 move independently of one another. For example, the restrictor rod 28 can be moved axially along the length of the hollow body 14 while the unstacker rod 22 remains in its starting position within the hollow body 14, or alternatively, the unstacker rod 22 may be moved axially through the hollow body 14 within the restrictor rod 28 while the restrictor rod 28 remains in its starting position within the hollow body 14. In other aspects, the restrictor rod 28 moves through the hollow body 14, followed by the unstacker rod 22, and vice versa. In other aspects, the restrictor rod 28 and the unstacker rod 22 can move collectively, such that both the restrictor rod 28 and the unstacker rod 22 move, for example, substantially simultaneously, through the hollow body 14 and permit, for example, release of the devices 12 stacked within the hollow body 14 such that the devices 12 become unstacked.

In aspects, the port 16 is in fluid communication with the hollow body 14 through either a top end 32, a bottom end 34, or through the top 32 and bottom end 34 of the hollow body 14. As would be understood in the art, there is no limitation to either the position of the port 16 relative to the hollow body 14, nor is there a limitation to the number of ports 16 that can be in fluid communication with the hollow body 14. For example, the reactor could comprise a single port 16 for fluid inflow and outflow or it could have two ports 16 at the bottom end 34 of the hollow body 14, where one is for fluid inflow and the other is for fluid outflow. The reactor could, alternatively or additionally, comprise one or more ports 16 at the top end 32 of the hollow body 14 for inflow and/or outflow.

In aspects, a port 16 at the top end of the hollow body is particularly useful for outflow of gas fluids, such as during purging as described herein. In additional or alternate aspects, the reactor is rotatable such that the presence of an outflow port 16 at the top end of the reactor is particularly useful for outflow of coating fluids when the reactor 10 is rotated or inverted.

In typical aspects, at least one port 16 is at or near the bottom end 34 of the hollow body 14 for introduction of the coating fluid into the hollow body 14 and at least one other port 16 is at or near the top 32 of the hollow body 14 for removal of the coating fluid, or vice versa.

Fluid flow in and out of port 16 can be initiated, controlled, and/or substantially or completely limited by any arrangement of upstream or downstream valves, pumps, reservoirs, mixers, purging chambers, etc. It will be understood that some solutions, for example, monomer, alcohol, and/or water washes, may be purged with monomer solution as desired.

Figure 6:
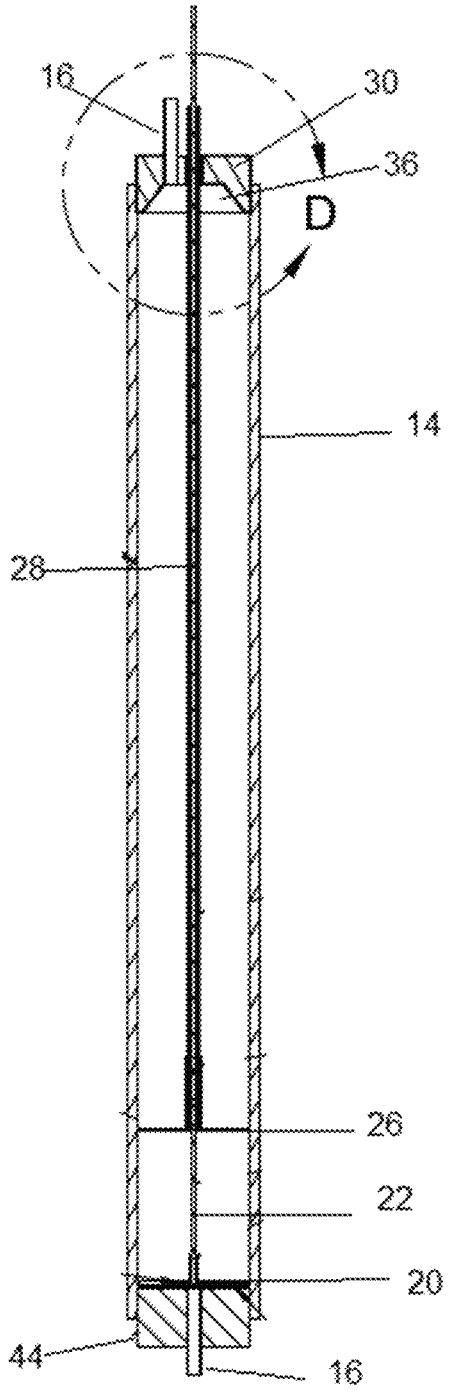
FIG. 6 shows a cross-sectional view of the assembled reactor of FIG. 2.
Figure 7:
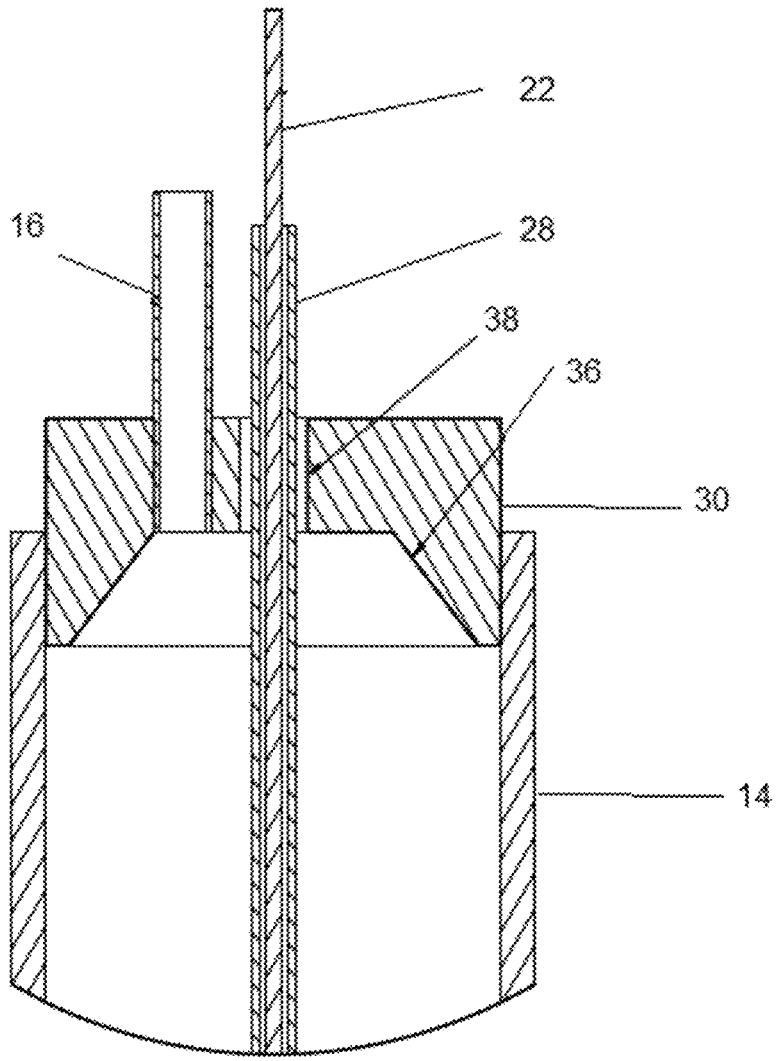
FIG. 7 shows a close-up cross-sectional view of a top of the reactor (D) in FIG. 6.
Figure 8:
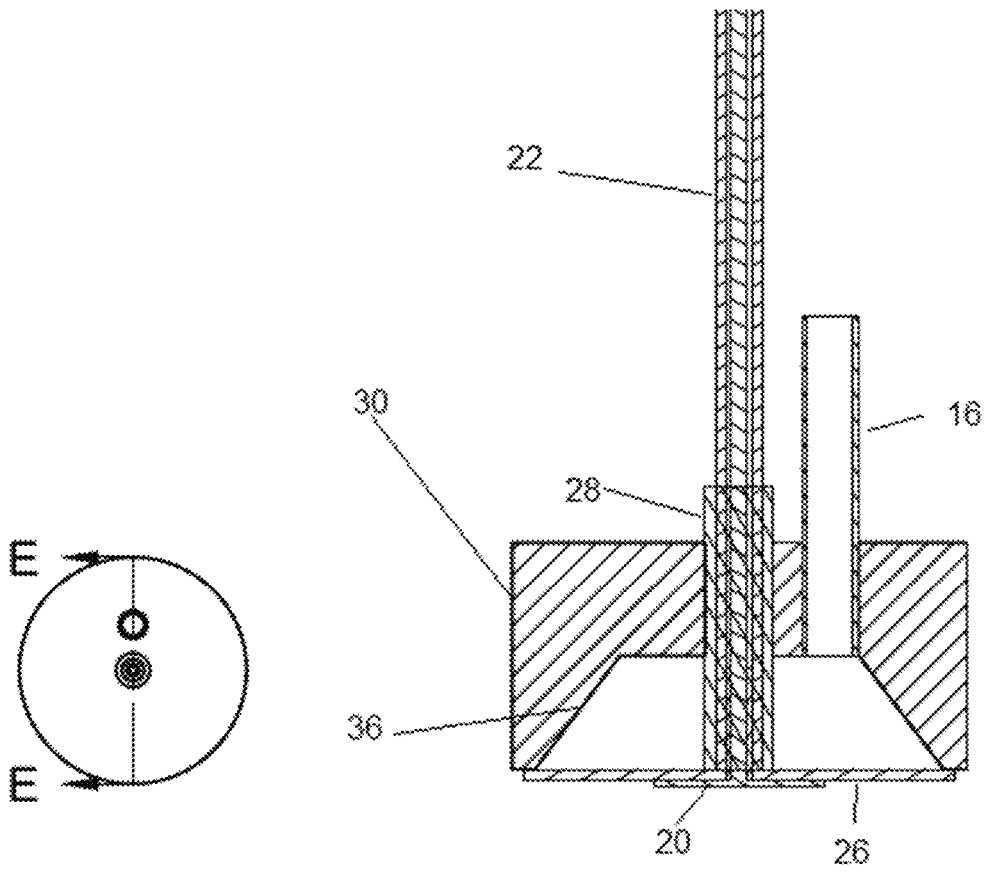
FIG. 8 shows a cross-sectional view of a top of the reactor of FIG. 1 when a restrictor and an unstacker are retracted.

FIGS. 6-8 show a cross-section of the top end 32 of the hollow body 14. In aspects, the reactor 10 further comprises a top stopper 30 at the top end 32 of the hollow body 14. In typical aspects, the top stopper 30 defines a void 36 that encourages the flow of fluid, such as gas, toward the port 16. In aspects, the port 16 passes through the stopper 30, such that the port 16 allows for fluid flow therefrom. In typical aspects, the void 36 has a convex shape for guiding fluid to the port 16. The convex shape is illustrated as being frustoconical, however, it will be appreciated that other shapes, such as conical, parabolic, etc are also contemplated.

As shown in FIGS. 6-8, the restrictor rod 28 and the unstacker rod 22 typically extend axially through the stopper 30. In this way, when the restrictor rod 28 and the unstacker rod 22 move axially through the hollow body 14 and thus through the stopper 30, the restrictor flange 26 and the unstacker flange 20 abut against the stopper 30.

Figure 4:
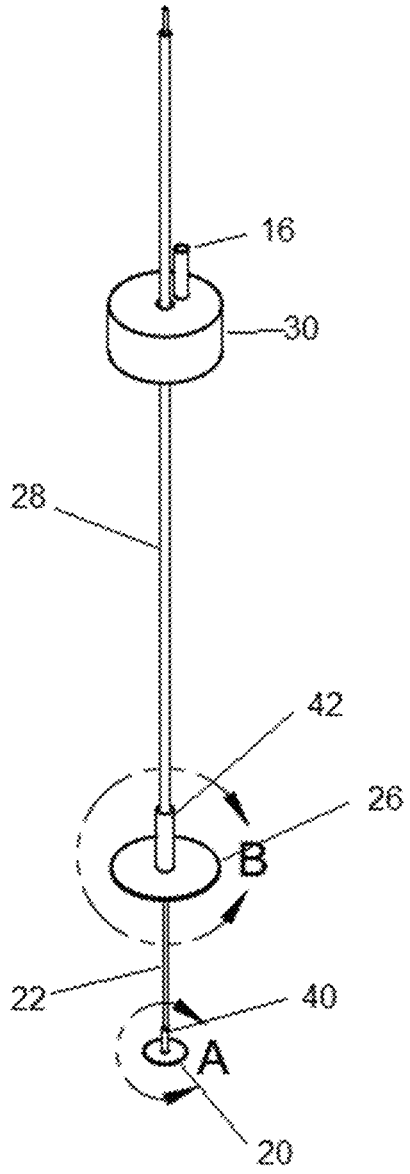
FIG. 4 shows a perspective view of an unstacker flange (A) and restrictor flange (B) of the reactor of FIG. 1.
Figure 5:
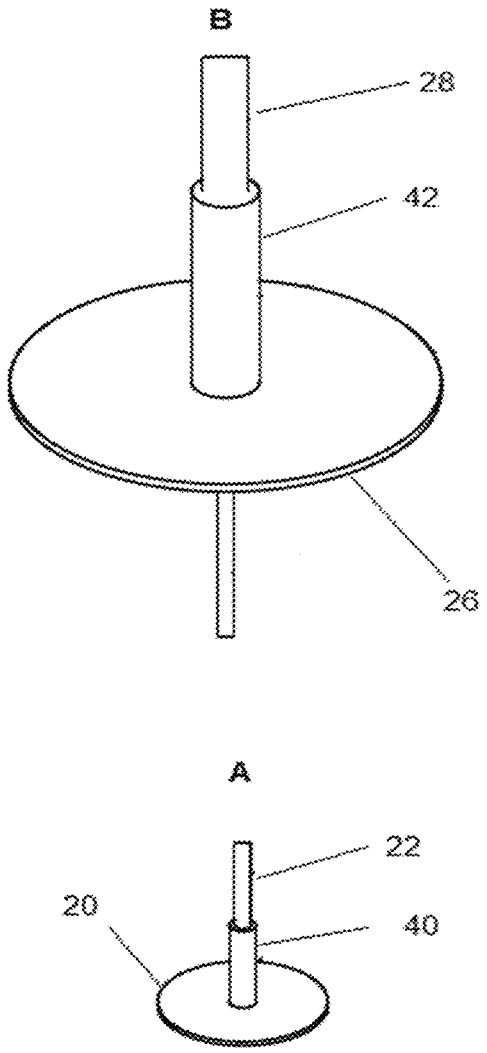
FIG. 5 shows a close-up view of unstacker flange (A) and the restrictor flange (B) of FIG. 4.

As best seen in FIGS. 4 and 5, the restrictor 24 and the unstacker 18 further comprise gaskets. In aspects, the unstacker 18 further comprises an unstacker gasket 40 and the restrictor 24 further comprises a restrictor gasket 42. In typical aspects, the unstacker gasket 40 is coupled to the unstacker rod 22 and, in typical aspects, the restrictor gasket 42 is coupled to the restrictor rod 28. In this way, when the restrictor rod 28 and the unstacker rod 22 are retracted axially through and/or out of the hollow body 14, the unstacker gasket 40 and restrictor gasket 42 collectively abut the surface of the rod insertion aperture 38 in the stopper 30 (FIG. 7) so as to substantially or completely limit fluid flow through the rod insertion aperture 38. When the fluid flow through port 16 is substantially or completely limited by an outside valve system, the concurrent abutment of the unstacker gasket 40 and restrictor gasket 42 with the surface of rod insertion aperture 38 can substantially or completely limit the flow of fluids through the stopper 30. It will be understood that it is the gaskets 40 and 42 that act to seal the stopper 30 and that flanges 20 and 26 do not need to abut the surface of the stopper 30 to accomplish such a seal. Moreover, while the flanges 20 and 26 are illustrated as abutting the surface of the stopper 30, this is done merely to maximize the volume of the hollow body. As will be appreciated, these could be configured differently depending upon the desired end use and volume capacity of the hollow body.

In typical aspects, the reactor 10 further comprises a bottom stopper 44 which is engageable with the bottom end 34 of the hollow body 14, to form, for example, a tight seal therewith. The bottom stopper 44 typically defines one or more apertures through which a corresponding port 16 extends so as to allow for, for example, inflow and/or outflow of coating fluids into the hollow body 14.

In aspects, the reactor 10 further comprises an aerator 46. In typical aspects, the aerator 46 is in communication with the port 16, typically underneath the stacked devices 12 when assembled within the hollow body 14. The aerator assists in uniformly dispersing fluids introduced into the hollow body, particularly gaseous fluids such as nitrogen, that may be introduced during a purging step in the process described herein.

In typical aspects, the reactor 10 is movable about an axis between a substantially vertical orientation and a substantially horizontal orientation. Movement between these orientations assists in unstacking the stacked devices 12 by disrupting the stacking through gravitational forces. For example, when the devices 12 are moved from the stacked orientation (FIG. 2) to the unstacked orientation (FIG. 3), through retraction of the restrictor flange 26 and/or the unstacker flange 20 and rotation of the hollow body, the devices 12 are then loosely contained and substantially evenly dispersed within the hollow body 14 in order to achieve effective and homogeneous polymerization of the coating fluids.

The restrictor rod 28 and/or the unstacker rod 22 may be a singular solid rod, or may two separate rods that are, for example, telescopically engaged to be operated independently or in tandem, or may be two separate rods that are not connected to one another and operate independently or in tandem. The restrictor rod 28 and/or the unstacker rod 22 may be made of any suitable material as long as the material does not impede the function of the restrictor rod 28 and/or the unstacker rod 22 (e.g. axial movement through the hollow body 14 and/or sliding engagement between the restrictor rod 28 and/or the unstacker rod 22).

The hollow body 14 has been described above as being cylindrical, however, it will be understood that it can have any suitable shape which may be determined at least in part by the shape and number of the desired devices to be coated.

To this regard, the reactor 10 finds use for coating any device 12 upon which a coating can be polymerized. Typically, the device is made of polymeric materials, such as polyurethanes, polyamides, polyesters, polyethers, polyorganosiloxanes, polysulfones, polytetrafluoroethylenes, polysiloxanes, silicone materials, poly(dimethylsiloxane)-based polymers, combinations thereof, and the like. Such polymers are typically used clinically in a variety of medical devices including in-dwelling medical devices and devices in general which comprise but are not limited to cardiac valves, dressings, pins, clamps, clips, syringes and their accessories, catheters, drains, stents, implants, tubings and the like. Coating of devices such as ocular lenses and/or their delivery devices is also contemplated herein.

The top stopper 30 and/or the bottom stopper 44 can be made of any material which is capable of forming a sealing engagement with the hollow body 14. Typically, the top stopper 30 and/or the bottom stopper 44 are made of rubber or silicone.

The coating fluid used during the coating process include, for example, a photoinitiator, a monomer, water, an alcohol, an oxygen-scavenging gas, and combinations thereof. Suitable photoinitiators for use in the photoinitiator solution comprise but are not limited to peresters, a-hydroxyketones, benzil ketals, benzoins and their derivatives and mixtures thereof. Specifically, suitable photoinitiators may be selected from 2,2-dimethoxy-2-phenyl-acetophenone (DPA), p-benzoyl tert-butylperbenzoate (BPB), benzophenone (BP) and mixtures thereof. Typically, the photoinitiator comprises benzophenone and tert-butylperoxybenzoate. One skilled in art would readily understand the type of photoinitiator that can be used in the process described herein.

It will be understood that the photoinitiator is typically in an alcohol-based solvent (for example, methanol, ethanol, isopropyl alcohol, or combinations thereof), which cause this solution to have a low surface tension, and hence aid in more efficient bubble removal from the surfaces of the devices.

The monomer is a polymerizable component within a polymerizable solution that can be photo-grafted onto the surface of the devices 12. Suitable monomers for use in the polymerizable solution comprise but are not limited to monomers sensitive to the presence of free radicals, that is, monomers capable of free radical polymerization such as acrylic acid, methacrylic acid, 2-carboxyethyl acrylate, 4-vinylbenzoic acid, itaconic acid, and mixtures thereof. Typically, the monomer is a combination of acrylic acid and methyl acrylate.

In typical aspects, the alcohol is a low surface tension alcohol, such as methanol, ethanol, isopropanol and combinations thereof.

Typically, the methods described herein include a step of purging liquid components with an oxygen-scavenging gas to reduce air bubbles and dissolved oxygen from the liquids. The oxygen-scavenging gas is, for example, nitrogen, argon, helium, or combinations thereof. In typical aspects, the oxygen-scavenging gas is nitrogen.

The reactor 10 is typically assembled by placing the unstacker rod 22 within the restrictor rod 28 such that the restrictor flange 26 and the unstacker flange 20 are spatially separated from one another and capable of holding the devices 12 therebetween (FIG. 1). This assembly can be placed in the hollow tube 14. When ready for use, the devices 12 are placed into hollow tube 14, with the unstacker flange 20 placed on top of the aerator 46 and the devices 12 placed on the unstacker 18, for example, the devices 12 are placed around the unstacker rod 22 such that the unstacker rod 22 penetrates the middle of the stacked devices 12. The restrictor flange 26 is then placed on top of the devices 12 to prevent the device 12 from lifting, for example, during nitrogen purging. Once the reactor 10 is assembled, the coating fluid can be introduced and exchanged within the hollow body 14 for coating the device 12. The assembled reactor 10 can be placed in the system 100 described below such that an array of reactors 10 can be swiveled between the substantially vertical and horizontal orientations to effect the unstacking of the devices 12 and therefore the coating of the devices 12 by the process described herein. A more detailed description of the process and the system 100 is provided below and are thus not repeated here in the interest of brevity.

System for Coating Devices

In general, the reactor 10 may be incorporated into a system 100 for coating the devices 12. The system 100 allows for a plurality of reactors 10 containing a plurality of devices 12 to simultaneously coat the devices 12. In this way, a large number of devices 12 can be coated quickly and efficiently in parallel. The system 100 comprises a reactor bracket 102 for supporting the reactors 10 and a swiveling mechanism 106, such as swiveling stand (FIGS. 9-16), for changing the orientation of the reactors 10. The orientation of the reactors 10 can be altered from a first orientation (FIG. 10) to a second orientation (FIG. 11). The change in orientation of the reactors 10 facilitates coating of the devices 12 by allowing the devices 12 to become unstacked in the second orientation.

Figure 10:
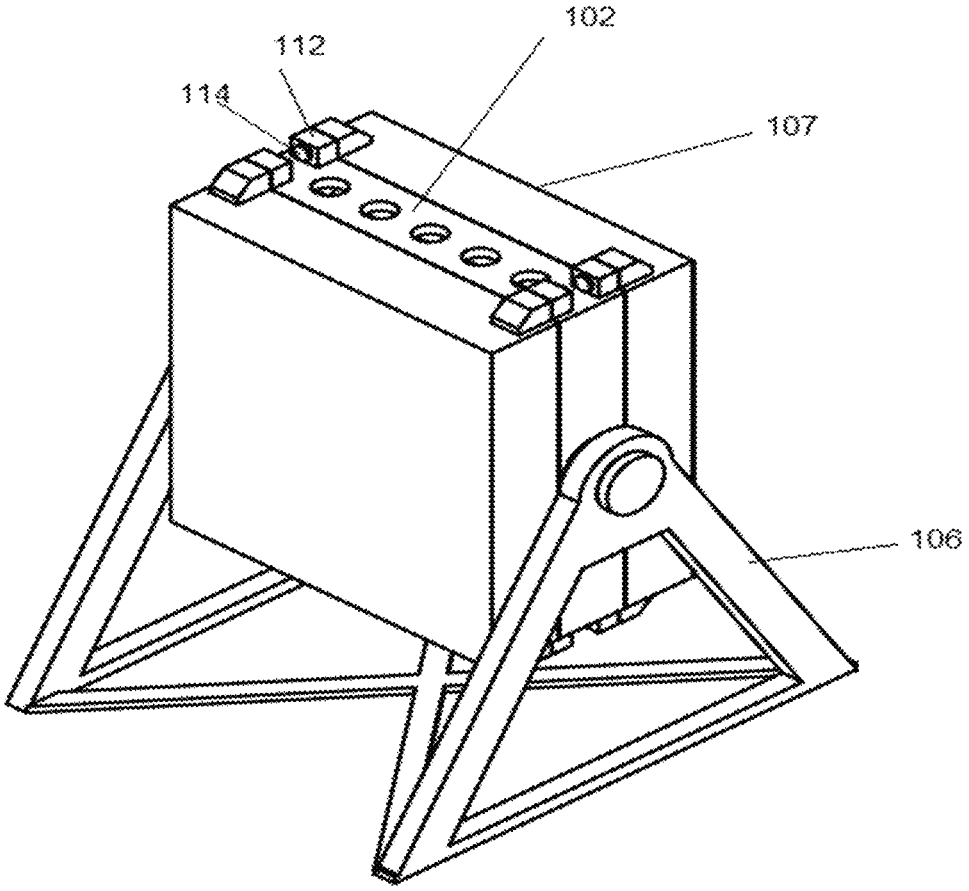
FIG. 10 shows a perspective view of the system of FIG. 9 in vertical orientation.
Figure 11:
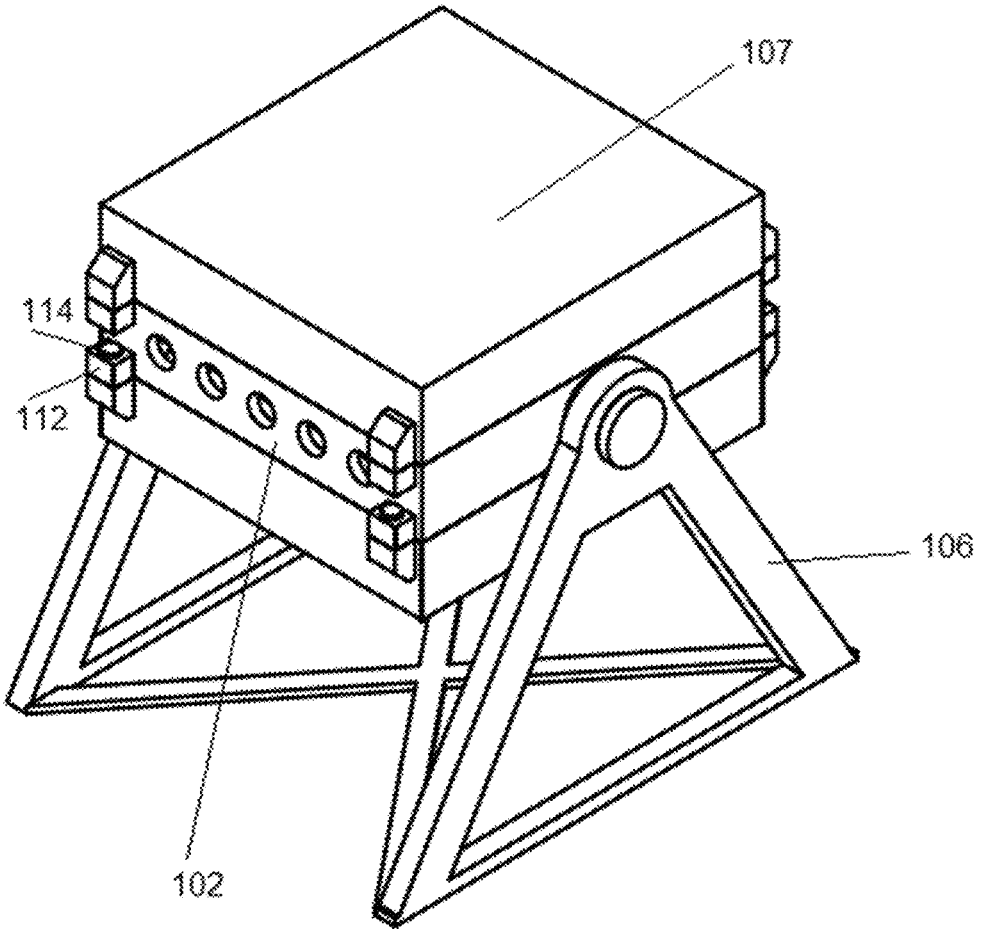
FIG. 11 shows a perspective view of the system of FIG. 9 in horizontal orientation.
Figure 12:
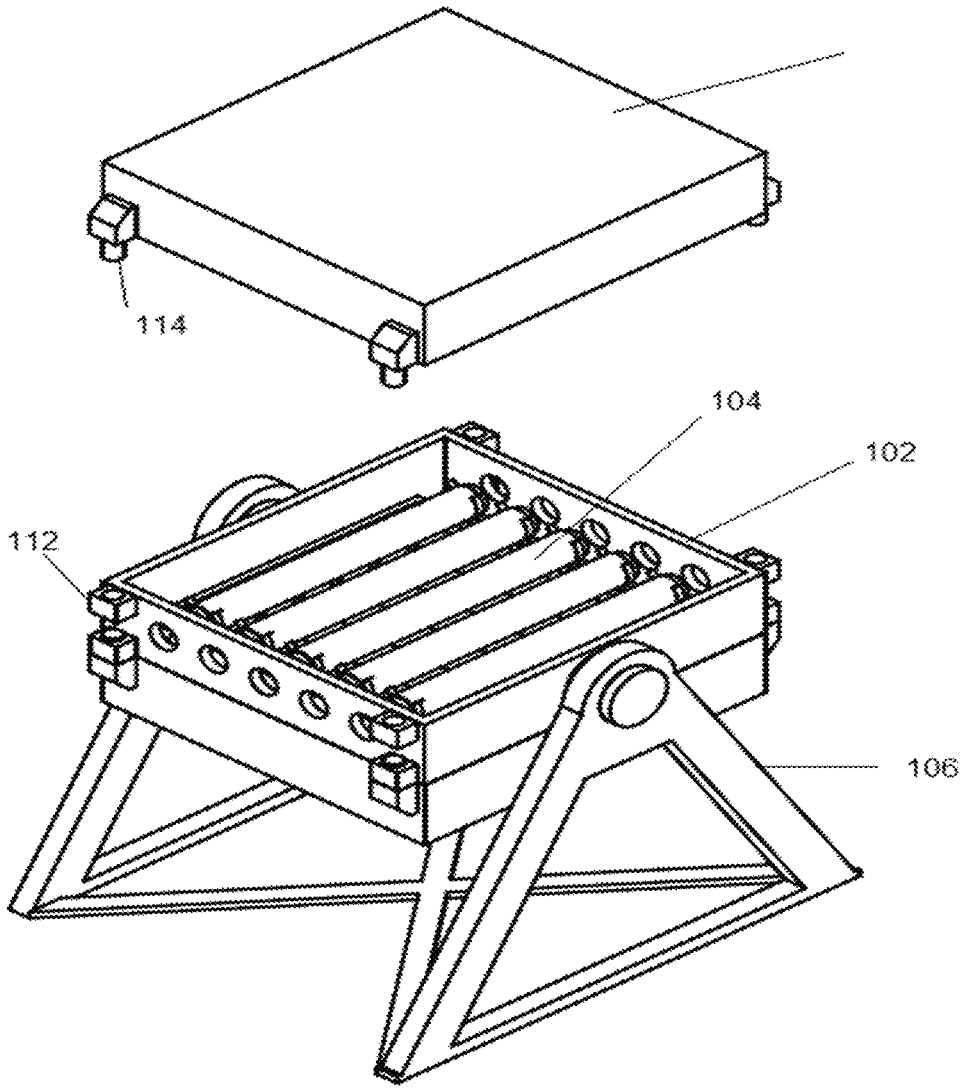
FIG. 12 shows a semi-exploded view of the system of FIG. 11.
Figure 13:
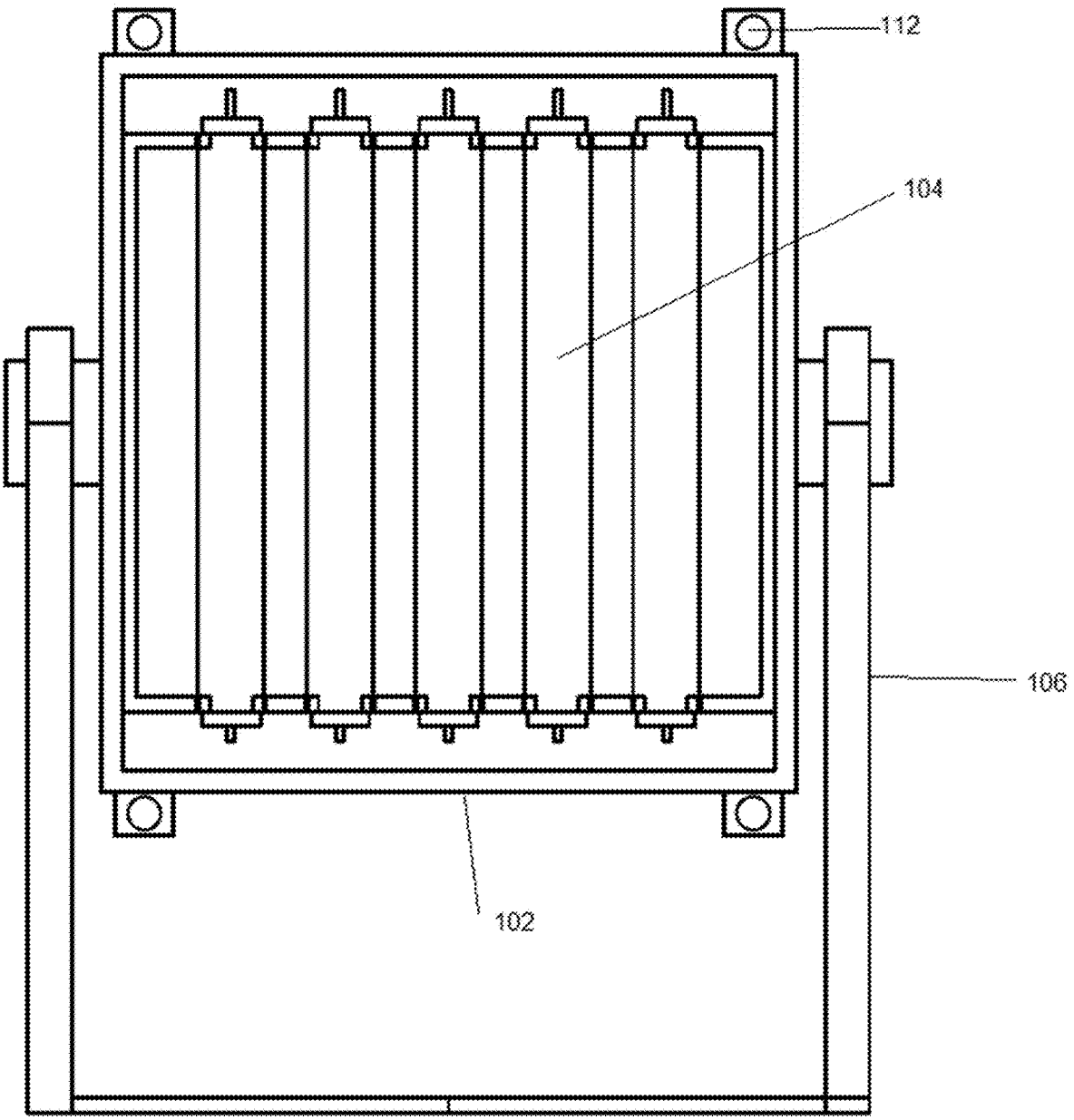
FIG. 13 shows a perspective front view of the system of FIG. 9 showing an array of reactors.
Figure 14:
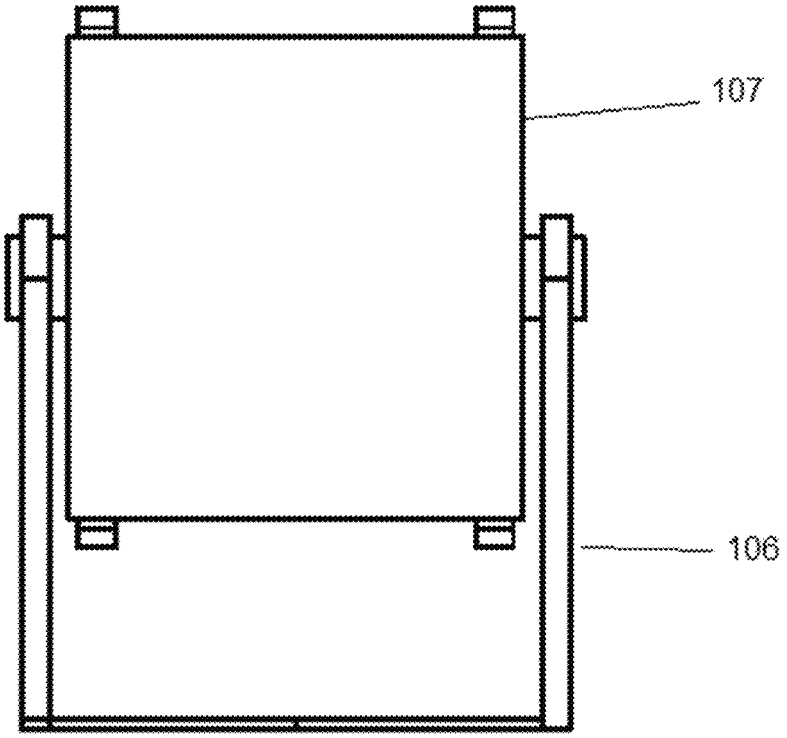
FIG. 14 shows a perspective back view of the system of FIG. 13.
Figure 15:
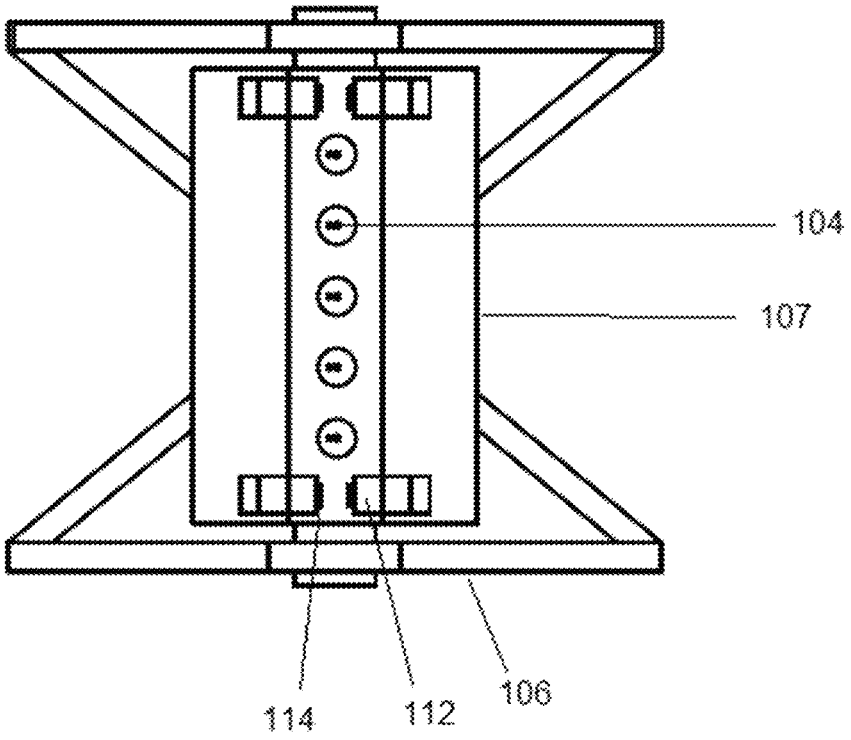
FIG. 15 shows a perspective top view of the system of FIG. 10.
Figure 16:
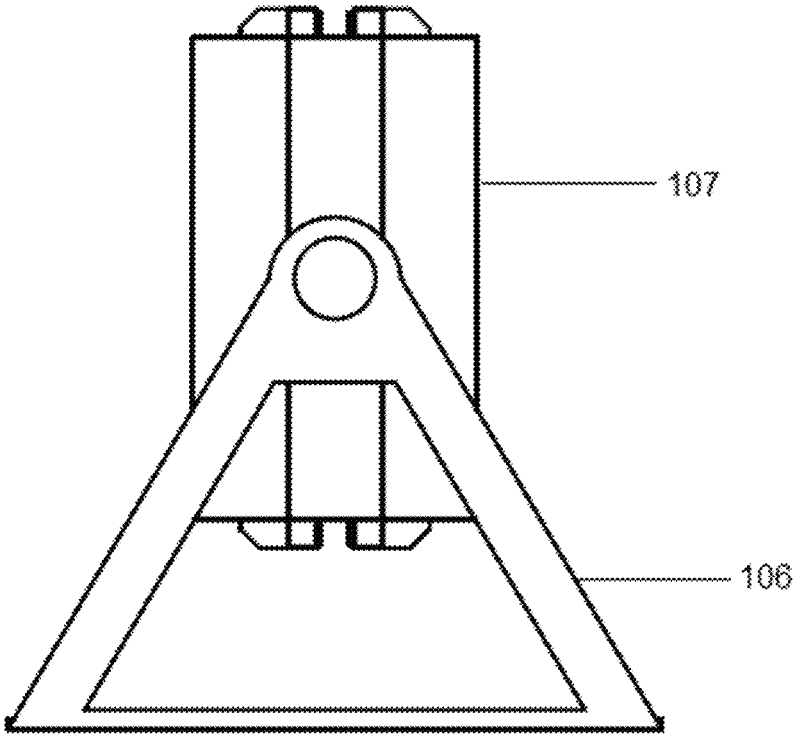
FIG. 16 shows a perspective side view of the system of FIG. 10.

In typical aspects, the first orientation is substantially vertical as shown in FIG. 2 and FIG. 10. In typical aspects, the second orientation is substantially horizontal as shown in FIG. 3 and FIG. 11. In typical aspects, the reactor bracket 102 comprises slots for housing an array 104 of reactors 10. The reactors 10 can be slideably and securably attached to the reactor bracket 102 such that the system 100 can, via, the swivel mechanism 106, change the orientation of the array 104 of reactors 10. In this way, the reactor bracket 102 can house multiple reactors 10 (e.g. a plurality of reactors 10) for timely and efficient coating of the devices 12. It is also contemplated that the swiveling mechanism 106 may permit full rotation of the reactor bracket 102. In this way, the swivel mechanism 106 is not limited to only substantially horizontal and vertical orientations.

In typical aspects, the system 100 further comprises a lamp assembly 108 for initiating the polymerization reaction. The lamp assembly 108 is attachable to the reactor bracket 102. The lamp assembly comprises a casing 107 that houses a UV light source, such as an array of bulbs 110 for the polymerization reaction. When assembled in the reactor bracket 102, each reactor 10 is flanked by the lamp assembly 108 which, via the bulbs 110, shines UV light though the hollow body 14 and into the interior of reactor 10. In typical aspects, the casing 107 of the lamp assembly 108 is attachable to the reactor bracket 102 via slots 112 coupled to the reactor bracket 102 and pins 114 coupled to the casing 107. In this way, the slots 112 can matingly receive the pins 114 such that the casing 107 is attached to the reactor bracket 102. As would be understood, the casing 107 and reactor bracket 102 may be connected to each other in a variety of other ways, such as, for example, screws and bolts, nails, snap fits, suction fits, and the like.

In typical aspects, once the reactor bracket 102 is attached to the swivel mechanism 106, such as a stand, and the casing 107 is attached to the reactor bracket 102, the coating fluid exchanging process can begin to coat the devices 12. In alternative aspects, the casing 107 may be attached to the reactor bracket 102 before and/or after the reactor bracket 102 has been orientated in the substantially or completely horizontal orientation (FIG. 10 and FIG. 11, respectively). In this way, when the casing 107 is attached the reactor bracket 102 after the positioning of the reactors 10 in the horizontal orientation, visualization of the coating fluid exchanging process is possible prior to initiation of the polymerization reaction. The system 100 allows for a smaller footprint such that several systems 100 could be set up in a workspace area for the simultaneous coating of a plurality of devices 12.

Process for Coating Devices

In general, the reactor 10 is useful for coating the devices 12 in a "one-pot" process. In this way, the process and accompanying equipment allow for the simultaneous coating of a large number of devices 12 in an efficient and cost-effective manner. Advantageously, the coating fluids are exchanged within the reactor 10 so that the devices 12 remain submerged throughout the process and the devices 12 are not exposed to air. In this way, the devices 12 are continually submerged in the coating fluids, thereby avoiding formation of gas bubbles in or around the devices 12 during the coating process. The one-pot process for coating the devices 12 comprises exchanging the coating fluids within the reactor 10, and coating the devices 12 with the coating fluids such that the coating fluid covers a surface of the devices 12.

The exchanging of coating fluids typically comprises exchanging the coating fluids in a continual and sequential fashion, starting with a photoinitiator and an oxygen-scavenging gas, followed by a pre-polymerization wash, then monomer addition, then polymerization, followed by a post-polymerization wash, and a final wash. In other aspects, the exchanging of coating fluids further comprises the use of a further coating fluid, such as a coating activation washes, or solutions containing therapeutic agents for the purpose of applying said therapeutic agents to the surface of the devices 12. It will be understood that this order may be modified, expanded or reduced as desired, for example, the coating activation wash, if included in the process, may precede the final wash. Once the reactor 10 is assembled, the exchanging of the coating fluids to coat the devices 12 can begin.

Photoinitiator:

In typical aspects, the process of exchanging the coating fluids begins with introduction of a photoinitiator. In typical aspects, the photoinitiator is introduced into the hollow body 14 such that the devices 12 are submerged in the photoinitiator. In typical aspects, the devices 12 are completely submerged in the photoinitiator when it is introduced into the hollow body 14. At this point, the devices 12 and photoinitiator are purged with the oxygen-scavenging gas (e.g. nitrogen) for a period of time. For example, the period of time is about 5 minutes, about 6 minutes, about 7 minutes, about 8 minutes or about 9 minutes. In typical aspects, the period of time is about 6 minutes. One skilled in the art would understand that the period of time depends on the time necessary to eliminate surface oxygen from the devices 12.

Typically, following the oxygen-scavenging gas purge, the devices 12 remain submerged in the photoinitiator for another period of time. For example, the period of time can range anywhere from 1 minute to 10 minutes, such as about 1, about 2, about 5, about 6, about 7, about 9, or about 10 minutes. In typical aspects, the period of time is about 6 minutes. One skilled in the art would understand that the period of time depends on the time necessary to allow for bubbles to evacuate the devices 12 due to, for example, the lower surface tension of the alcohol-based photoinitiator solution. In additional or alternative aspects, one skilled in the art would understand that the period of time depends on the time necessary to introduce a sufficient concentration of the photo-initiator within the surfaces of the devices 12.

Pre-Polymerization Wash:

In typical aspects, following submersion in the photoinitiator, a pre-polymerization wash (e.g. 70% alcohol, 30% deionized water, optionally pre-purged with nitrogen gas) is introduced into the hollow body 14 of the reactor 10 by exchanging the fluids and keeping the devices submerged. The pre-polymerization wash is used to wash out excess photoinitiator residue that may remain behind on surfaces of the reactor. In typical aspects, the washing comprises use of about 2 times, about 3 times or about 4 times the hollow body 14 volume so as to thoroughly wash the reactor without substantially removing photoinitiator that is imbibed in the surfaces of the devices 12. In typical aspects, the washing comprises about 3 times the hollow body 14 volume.

Typically, following the alcohol washing step, deionized water, which is typically pre-purged with nitrogen gas, is introduced into the hollow body 14 by fluid exchange and keeping the devices submerged, in order to wash out the residual alcohol. In typical aspects, the washing comprises use of about 2 times, about 3 times or about 4 times, the hollow body 14 volume to wash the hollow body 14. In typical aspects, the washing comprises about 3 times the hollow body 14 volume.

Monomer:

In typical aspects, after the washing of the devices 12 with water, a monomer solution is introduced into the hollow body 14 through gradual fluid exchange while keeping the devices submerged. In typical aspects, when the monomer substantially or completely replaces the previous coating fluid, the unstacker 18 is retracted within the hollow body 14 and the reactor is rotated to a substantially horizontal position. The retraction and rotation may occur simultaneously or sequentially in any order, whereby retraction may occur first or rotation may occur first, followed by rotation or retraction, respectively. Retraction of the unstacker 18 displaces a core of the stacked devices 12, creating a gap that allows further unstacking and movement. Rotation of the reactor may comprise rotating the reactor back and forth, for example, to promote substantially even dispersal of the devices 12 throughout the hollow body 14.

Polymerization:

In typical aspects, once the devices 12 described herein are substantially evenly dispersed within the hollow body 14, the hollow body 14 is held or locked in the substantially horizontal orientation and the devices are exposed to a UV light source to commence polymerization. In other embodiments, the hollow body 14 is continuously rotated between the substantially horizontal orientation and substantially vertical orientations, or different points in between, for the duration of the polymerization step to ensure that all devices are equally exposed to the UV light. In typical aspects, the UV light source has a wavelength of between about 100 nm and about 400 nm, such as for example, between about 100 nm and about 200 nm, or about 100 nm and about 300 nm, or about 200 nm and about 300 nm, or about 200 nm and about 400 nm or about 300 nm and about 400 nm. Typically, the UV light source has a wavelength of between about 300 nm and about 365 nm. The devices 12 are exposed to a UV light source for a period of time. For example, the period of time is about 5 minutes, about 6 minutes, about 7 minutes, or about 8 minutes. Typically, the period of time is about 6 minutes. One skilled in the art would understand that polymerization time depends on, for example, the devices 12 and photoinitiator or monomer concentrations being used in the polymerization reaction.

Post-Polymerization Wash:

Following polymerization, the devices are typically restacked by rotating the reactor back to the substantially vertical orientation and tapping the devices with the restrictor. Complete stacking of devices is not required in this step and typically the devices assume a compact but a semi-random orientation. The presence of a hydrophilic coating (grafted on to the surface of the devices in previous steps) alleviates the need for perfect stacking and alignment as, at this stage, the subsequent solutions penetrate coated devices more easily.

In typical aspects, following polymerization, the monomer described herein is replaced with another alcohol wash solution. It will be understood that once polymerization has been completed, subsequent fluid washing steps may be carried out by fluid exchange, keeping the devices submerged as described above, or by removing the monomer or wash solution and subsequently replacing it with the next solution. Typically, gradual fluid exchange is continued throughout these following steps. In typical aspects, the alcohol comprises about 2 times, about 3 times or about 4 times the hollow body 14 volume. In typical aspects, the alcohol wash to remove the monomer described herein comprises about 2 times the hollow body 14 volume. In aspects, when the monomer has been completely replaced with alcohol, the drain is closed, and the devices 12 are allowed to sit in the alcohol for a period of time. For example, the period of time is about 5 minutes, about 6 minutes, about 7 minutes, or about 8 minutes, while the hollow body 14 is gently inverted back and forth. Typically, the period of time is about 6 minutes. It will be understand that the period of time depends on the time necessary to ensure that unreacted photoinitiator and monomer molecules are washed out of devices 12 described herein.

Final Wash:

In typical aspects, after the above steps of the coating process are completed, the process concludes with washing the devices 12 described herein with deionized water. Typically, washing with deionized water rinses any excess alcohol wash solution from the devices 12 described herein.

Coating Activation:

In aspects, and if desired by the user, following the post-polymerization wash described above, the alcohol solution is replaced with an activating solution that prepares the coating for binding to an active agent. In typical aspects, the activating solution is an alkaline solution, such as TRIS base (Tris(hydroxymethyl)aminomethane) at concentrations between 1 to 100 mM (typically 10 and 50 mM), which can deprotonate acidic groups within the coating on the surface of the devices 12. The activating solution, when used, is typically delivered to the hollow body 14 as described above. In typical aspects, the activating solution is introduced into the hollow body 14 at about 2 times, about 3 times or about 4 times the hollow body 14 volume. Typically, the activating solution is used at about 2 times the hollow body 14 volume. In aspects, when the alcohol solution has been completely replaced with the activating solution, the drain is closed, and the devices 12 are allowed to sit in the activating solution for a period of time. For example, the period of time is about 5 minutes, about 6 minutes, about 7 minutes, or about 8 minutes, while the hollow body 14 is gently inverted back and forth. Typically, the period of time is about 6 minutes. Once the coating surface of the device 12 has been appropriately activated, a solution containing a therapeutic agent is introduced into the hollow body 14 as described above. Typically, the therapeutic agent is, for example, an antimicrobial agent (e.g. antibacterial, anti-fungal, anti-viral, innate immune peptides or proteins, silver ions, antiseptic agents), an anti-proliferative agent, an antineoplastic agent, an analgesic agent, or an anti-inflammatory agent. It will be understood that any suitable agent can be incorporated in the devices and methods described herein. When the surfaces of the device 12 incorporate an antimicrobial agent, the device 12 can be used to treat or prevent an infection that may otherwise compromise a patient by the use of the device 12. As would be understood, the period of contact between the therapeutic agent and coated devices 12 described herein is dependent on the desired concentration of agent on the device 12 and can typically range anywhere from a few seconds of coating time to several minutes of coating time.

The coating process described herein can be fully automated, semi-automated or manual. The process described herein reduces the occurrence of trapped gas bubbles in and/or on the devices during a coating process, as compared to, for example, a process that involves sequentially dipping devices into various solutions. Since the processes described herein are "wet processes", the products are not dried between each step. This permits a faster operation and coating process as compared to process that require drying in between various steps, and also limits the exposure to air/formation of bubbles in and/or on the devices 12 as described herein. In addition, the process described herein allows for all the fluid exchange to take place in a single reactor 10, as opposed to several separate stations, thereby eliminating the requirement for additional equipment/machinery to complete the coating process.

The above disclosure generally describes the present invention. A more complete understanding can be obtained by reference to the following specific Examples. These Examples are described solely for purposes of illustration and are not intended to limit the scope of the invention. Changes in form and substitution of equivalents are contemplated as circumstances may suggest or render expedient. Although specific terms have been employed herein, such terms are intended in a descriptive sense and not for purposes of limitation.

EXAMPLES

Example 1: Lubricious Polyurethane Extrusions

The general coating process described above was specifically applied to 55 mm-long tubular polyurethane extrusions with an inner diameter (ID) of approximately 0.76 mm and an outer diameter (OD) of approximately 1 mm. The purpose of the coating was to render the extrusions lubricious. As part of the process, a coating-specific dye was applied to the coated devices 12 to facilitate visual examination of coating consistency on inner and outer surfaces of the tubular devices. The process was carried out as follows:

1. A 50-cm long hollow borosilicate glass tube with an ID of 2.5 cm was used as hollow body 14
2. Approximately 400 devices 12 were stacked inside hollow body 14
3. Reactor 10 was assembled as per the general coating process description above and swiveled to the vertical orientation
4. A volume of photoinitiator solution (400 mM benzophenone and 400 mM tert-butylperoxybenzoate dissolved in isopropyl alcohol) sufficient to fully submerge devices 12 was introduced into reactor 10 through top port 16.
5. A constant flow of nitrogen gas was introduced through bottom port 16 for 6 min. Top port 16 was opened to atmosphere to act as an outlet for nitrogen gas
6. After the nitrogen flow was stopped, devices 12 were incubated in the photoinitiator solution for an additional 3 min. During this time, restrictor 24 was moved up and down several times to gently tap the stack of devices 12 in order to dislodge residual gas bubbles
7. About 3 times the hollow body 14 volume of 70% isopropyl alcohol wash solution (7 parts isopropyl alcohol, 3 parts water, pre-purged with nitrogen gas for at least 10 min) was introduced from top port 16, while the fluid mixture in reactor 10 was drained from bottom port 16. Flow rates in and out of reactor 10 were modulated to ensure that the stack of devices 12 always remained submerged in fluid
8. About 3 times the hollow body 14 volume of water (pre-purged with nitrogen gas for at least 10 min) was introduced from top port 16, while the fluid mixture in reactor 10 was drained from bottom port 16. Flow rates in and out of reactor 10 were modulated to ensure that the stack of devices 12 always remained submerged in fluid
9. Hollow body 14 was filled with monomer solution (300 mM acrylic acid, 50 mM methyl acrylate dissolved in water, pre-purged with nitrogen gas for at least 10 min) through bottom port 16. Top port 16 was opened to atmosphere to act as an outlet for gas. As hollow body 14 filled with monomer solution, restrictor 24 and unstacker 18 were retracted such that unstacker gasket 40, restrictor gasket 42, and top stopper 30 formed a tight seal. The retraction of the unstacker also achieved unstacking of devices 12
10. Reactor 10 was swiveled between the vertical and horizontal orientations to further effect the unstacking of devices 12
11. Reactor 10 was swiveled to horizontal orientation and exposed to UV irradiation for 8 min
12. Reactor 10 was swiveled to vertical orientation and devices 12 were allowed to settle at the bottom end of the hollow body 14. Restrictor 24 was moved up and down several times to promote re-stacking of devices 12.
13. Monomer solution was drained from reactor 10 through bottom port 16, and a volume of isopropyl alcohol sufficient to fully submerge devices 12 was introduced into reactor 10 through top port 16. Devices 12 were incubated in isopropyl alcohol for 6 minutes
14. Isopropyl alcohol was drained from reactor 10 through bottom port 16, and a volume of activating alkaline solution 1 (50 mM Tris(hydroxymethyl)aminomethane) sufficient to fully submerge devices 12 was introduced into reactor 10 through top port 16. Devices 12 were incubated in activating alkaline solution 1 for 6 minutes
15. Activating alkaline solution 1 was drained from reactor 10 through bottom port 16, and a volume of coating-specific dye solution (160 μM Brilliant Green, 10 mM Silver Acetate, 10 mM Pyroglutamic acid dissolved in water) sufficient to fully submerge devices 12 was introduced into reactor 10 through top port 16. Devices 12 were incubated in coating-specific dye solution for 6 minutes
16. Coating-specific dye solution was drained from reactor 10 through bottom port 16, and a volume of activating alkaline solution 2 (10 mM Tris(hydroxymethyl)aminomethane) sufficient to fully submerge devices 12 was introduced into reactor 10 through top port 16. Devices 12 were incubated in activating alkaline solution 2 for 6 minutes
17. Activating alkaline solution 2 was drained from reactor 10 through bottom port 16, and a volume of water sufficient to fully submerge devices 12 was introduced into reactor 10 through top port 16. Devices 12 were incubated in water for 6 minutes
18. Devices 12 were removed from reactor 10, spread out and dried at ambient temperature for at least 12 hours
19. Each device was visually examined for inconsistencies (voids) in coating, revealed by absence of coating-specific staining in significant portions of a device To compare the performance of the present invention (one-pot approach) to a more conventional coating approach (multi-station approach), the following process was carried out:

1. Approximately 400 devices 12 were incubated in the photoinitiator solution (400 mM benzophenone and 400 mM tert-butylperoxybenzoate dissolved in isopropyl alcohol) station for 9 minutes
2. Devices 12 were incubated in 70% isopropyl alcohol wash solution station for 1 minute 3. Devices 12 were incubated in water wash station for 1 minute
4. Devices 12 were moved to a 50-cm long hollow borosilicate glass tube with an ID of 2.5 cm (monomer station) filled with monomer solution (300 mM acrylic acid, 50 mM methyl acrylate dissolved in water). A constant flow of nitrogen gas was introduced through the monomer solution for 6 min, after which the devices 12 in the monomer station were exposed to UV irradiation for 8 min
5. Devices 12 were incubated in isopropyl alcohol wash station for 6 min
6. Devices 12 were incubated in activating alkaline solution 1 (50 mM Tris(hydroxymethyl)aminomethane) station for 6 min
7. Devices 12 were incubated in coating-specific dye solution (160 μM Brilliant Green, 10 mM Silver Acetate, 10 mM Pyroglutamic acid dissolved in water) station for 6 min
8. Devices 12 were incubated in activating alkaline solution 2 (10 mM Tris(hydroxymethyl)aminomethane) station for 6 min
9. Devices 12 were incubated in water wash station for 1 minute
10. Devices 12 were removed from water wash station, spread out and dried at ambient temperature for at least 12 hours
11. Each device was visually examined for inconsistencies (voids) in coating, revealed by absence of coating-specific staining in significant portions of a device Consistency of coating produced by the two approaches described above was compared on the basis of proportion of devices with notable inconsistencies (voids) in coating, the results are summarized in the following table.

| Coating approach | No coating inconsistencies | Minor coating inconsistencies | Severe coating inconsistencies |
|---|---|---|---|
| Single-pot approach | 74% | 26% | 0% |
| Multi-station approach | 0.5% | 4% | 95.5% |

The above disclosure generally describes the present invention. Although specific terms have been employed herein, such terms are intended in a descriptive sense and not for purposes of limitation.

Patent applications, patents, and publications are cited herein to assist in understanding the embodiments described. All such references cited herein are incorporated herein by reference in their entirety and for all purposes to the same extent as if each individual publication or patent or patent application was specifically and individually indicated to be incorporated by reference in its entirety for all purposes. To the extent publications and patents or patent applications incorporated by reference contradict the disclosure contained in the specification, the specification is intended to supersede and/or take precedence over any such contradictory material.

Although specific embodiments of the invention have been described herein in detail, it will be understood by those skilled in the art that variations may be made thereto without departing from the spirit of the invention or the scope of the appended claims.

It will be understood that certain of the above-described structures, functions, and operations of the above-described embodiments are not necessary to practice the present invention and are included in the description simply for completeness of an exemplary embodiment or embodiments. In addition, it will be understood that specific structures, functions, and operations set forth in the above-described referenced patents and publications can be practiced in conjunction with the present invention, but they are not essential to its practice. It is therefore to be understood that the invention may be practiced otherwise than as specifically described without actually departing from the spirit and scope of the present invention as defined by the appended claims.

We claim:

1. A reactor for coating a plurality of devices, the reactor comprising:

a hollow body for supporting the plurality of devices;

a port in fluid communication with the hollow body for exchanging a coating fluid; and a restrictor for encouraging a stacked orientation of the plurality of devices, wherein the restrictor is movable along a length of the hollow body, and wherein the restrictor comprises a restrictor flange.

2. The reactor of claim 1, wherein the plurality of devices are movable within the hollow body from the stacked orientation to an unstacked orientation.

3. The reactor of claim 2, wherein the hollow body is sufficiently longer than the plurality of devices to permit the plurality of devices to move substantially freely within the hollow body in the unstacked orientation.

4. The reactor of claim 3, wherein the hollow body is at least 50%, 60%, 70%, 80%, 90%, 100%, 110%, 120%, 130%, 140%, 150%, 160%, 170%, 180%, 190%, 200%, 250%, 300%, 350%, 400%, 450%, 500%, 550%, or 600% longer than the plurality of devices.

5. The reactor of claim 2, wherein the hollow body has a cross-sectional area that is sufficiently similar to that of the plurality of devices in the stacked orientation to restrict the plurality of devices from moving substantially freely within the hollow body in the stacked orientation.

6. The reactor of claim 2, wherein the hollow body has a diameter that is smaller than the length of the plurality of devices to ensure that the plurality of devices remains in a desired orientation in the unstacked orientation.

7. The reactor of claim 2, further comprising an unstacker for releasing the plurality of devices from the stacked orientation, wherein the unstacker is movable along the length of the hollow body, and wherein the unstacker comprises an unstacker flange.

8. The reactor of claim 7, wherein movement of the unstacker flange disrupts the stacked orientation.

9. The reactor of claim 8, wherein movement of the unstacker flange provides a gap between a plurality of stacked devices, that disrupts the stacked orientation.

10. The reactor of claim 8, wherein the unstacker flange is porous and/or flexible.

11. The reactor of claim 7, wherein the unstacker further comprises an unstacker rod coupled to the unstacker flange for movement of the unstacker flange through the hollow body, wherein the unstacker rod extends axially through the hollow body.

12. The reactor of claim 1, wherein the movement of the restrictor flange allows for release of the plurality of devices from the stacked orientation.

13. The reactor of claim 1, wherein the restrictor further comprises a restrictor rod coupled to the restrictor flange for movement of the restrictor flange through the hollow body, wherein the restrictor rod extends axially through the hollow body and the restrictor rod.

14. The reactor of claim 13, wherein the unstacker rod and the restrictor rod move independently from each other or collectively.

15. The reactor of claim 1, wherein the port is at a top and/or a bottom of the hollow body and further comprising a top and/or bottom stopper at a top and/or bottom end of the hollow body, wherein the port at the top of the hollow body extends through the top stopper for gas flow, wherein the top stopper defines a void having a convex shape to guide fluid to the port, and wherein the port at the bottom of the hollow body extends through the bottom stopper for exchanging the coating fluid.

16. The reactor of claim 15, wherein the restrictor rod and/or the unstacker rod extend through the top stopper and wherein when the unstacker rod and the restrictor rod move through the top stopper, a gasket coupled to the unstacker rod slides into a gasket coupled to the restrictor rod that collectively abut against a surface of the top stopper to limit fluid flow through the top stopper in the unstacked orientation.

17. The reactor of claim 15, wherein the port at the bottom of the hollow body extends through the bottom stopper for exchanging the coating fluid.

18. The reactor of claim 1, further comprising an aerator.

19. The reactor of claim 1, wherein the hollow body comprises glass.

20. The reactor of claim 1, wherein the plurality of devices are selected from the group consisting of cardiac valves, dressing, pins, clamps, clips, syringes, syringe accessories, catheters, drains, stents, implants, tubings, ocular lenses, and their delivery devices.

21. The reactor of claim 1, wherein each of the plurality of devices is substantially identical.

22. The reactor of claim 21, wherein the plurality of devices remain in contact during the exchange of the coating fluid.

23. The reactor of claim 22, wherein the fluid exchange reduces air bubbles in and/or around the plurality of devices, optionally in respective lumens of the plurality of devices.

24. The reactor of claim 22, wherein the plurality of devices are not exposed to air during or after the exchange of coating fluid.

25. The reactor of claim 1, wherein the reactor is for coating the plurality of devices in a one-pot process of coating fluid exchange.

26. A reactor for coating a plurality of devices, the reactor comprising:

a hollow body for supporting the plurality of devices;

a port in fluid communication with the hollow body for exchanging a coating fluid;

wherein the reactor is movable between a substantially vertical position and a substantially horizontal position, wherein movement from the substantially vertical position to the substantially horizontal position encourages an unstacked orientation of the plurality of devices.

27. The reactor of claim 26, wherein the unstacked orientation and/or the substantially horizontal position encourages substantially uniform covering of the plurality of devices with the coating fluid and/or substantially even dispersion of the plurality of devices throughout the hollow body.

28. A system comprising a reactor bracket for supporting a reactor;

the reactor comprising:

a hollow body for supporting a plurality of devices;

a port in fluid communication with the hollow body for exchanging a coating fluid; and a restrictor for encouraging a stacked orientation of the plurality of devices, wherein the restrictor is movable along a length of the hollow body, and wherein the restrictor comprises a restrictor flange;

and a swiveling mechanism for changing the orientation of the reactor bracket from a first orientation to a second orientation, wherein the first orientation is a substantially vertical orientation and the second orientation is a substantially horizontal orientation.

29. The system of claim 28, further comprising a lamp assembly attachable to the reactor bracket for initiating a polymerization reaction within the reactor.

30. The system of claim 28, comprising one or more of the reactors.

31. The system of claim 28, further comprising a lamp assembly attachable to the reactor bracket for initiating a polymerization reaction within the reactor.

32. The system of claim 28, comprising one or more of the reactors.

33. A one-pot process for coating a device, the process comprising:

exchanging a coating fluid within a reactor; and coating the device with the coating fluid such that the coating fluid covers a surface of the device; wherein the device is continually submerged in the coating fluid such that the device is not exposed to air.

34. The process of claim 33, wherein the exchanging coating fluid minimizes bubble formation inside and/or outside the device.

35. The process of claim 33, comprising submerging the device in alcohol to removing air bubbles and exchanging subsequent fluids while keeping the device submerged without substantially exposing the device to air.

36. A system comprising:

a reactor bracket for supporting a reactor;

the reactor comprising:

a hollow body for supporting the plurality of devices;

a port in fluid communication with the hollow body for exchanging a coating fluid; wherein the reactor is movable between a substantially vertical position and a substantially horizontal position, wherein movement from the substantially vertical position to the substantially horizontal position encourages an unstacked orientation of the plurality of devices; and a swiveling mechanism for changing the orientation of the reactor bracket from a first orientation to a second orientation, wherein the first orientation is a substantially vertical orientation and the second orientation is a substantially horizontal orientation.

* * * * *